US009393499B1

(12) United States Patent
Flanagan

(10) Patent No.: US 9,393,499 B1
(45) Date of Patent: Jul. 19, 2016

(54) WATER ROCKET TOYS, ASSEMBLIES, COMPONENTS, AND METHODS

(71) Applicant: Adam L. Flanagan, Morwell (AU)

(72) Inventor: Adam L. Flanagan, Morwell (AU)

( * ) Notice: Subject to any disclaimer, the term of this patent is extended or adjusted under 35 U.S.C. 154(b) by 0 days.

(21) Appl. No.: 14/719,294

(22) Filed: May 21, 2015

Related U.S. Application Data

(60) Provisional application No. 62/001,249, filed on May 21, 2014.

(51) Int. Cl.

| | |
|---|---|
| ***A63H 27/26*** | (2006.01) |
| ***A63H 3/00*** | (2006.01) |
| ***A63H 27/00*** | (2006.01) |
| ***A63H 27/14*** | (2006.01) |
| ***A63H 3/48*** | (2006.01) |
| ***A63H 33/20*** | (2006.01) |

(52) U.S. Cl.
CPC ..... *A63H 3/003* (2013.01); *A63H 3/48* (2013.01); *A63H 27/005* (2013.01); *A63H 27/14* (2013.01); *A63H 33/20* (2013.01)

(58) Field of Classification Search
CPC ..... A63H 27/14
USPC ..... 446/52, 56, 72, 73, 74, 211, 212, 230, 446/231, 308, 309, 311; 124/56, 57, 61, 63, 124/71, 72, 73, 74, 76
See application file for complete search history.

(56) References Cited

U.S. PATENT DOCUMENTS

| | | | | | |
|---|---|---|---|---|---|
| 1,785,770 | A * | 12/1930 | Faber | F42B 10/56 | 102/354 |
| 2,675,642 | A * | 4/1954 | Coleman | A63H 27/005 | 124/26 |
| 2,718,093 | A * | 9/1955 | Payne | F41F 33/20 | 446/52 |
| 3,139,794 | A * | 7/1964 | Barnes, Jr. | F41F 3/04 | 102/377 |
| 3,257,752 | A * | 6/1966 | Gordon, III | A63H 33/20 | 446/51 |
| 3,902,271 | A * | 9/1975 | Turoff | A63H 27/14 | 124/21 |
| 3,937,191 | A * | 2/1976 | Green | F41F 3/052 | 124/34 |
| 4,008,541 | A * | 2/1977 | Russer | A63H 33/20 | 446/51 |
| 4,452,412 | A * | 6/1984 | von Pragenau | B64G 1/002 | 244/171.3 |
| 5,217,187 | A * | 6/1993 | Criswell | B64G 1/002 | 244/171.3 |
| 5,407,375 | A * | 4/1995 | Johnson | A63H 27/005 | 446/486 |

(Continued)

*Primary Examiner* — Melba Bumgarner
*Assistant Examiner* — Joseph B Baldori
(74) *Attorney, Agent, or Firm* — Fantastic IP Consulting; Eduardo E. Drake

(57) ABSTRACT

The present inventor recognized that children's interest in conventional water rockets can wane rapidly over time, particularly as children are drawn to other types of toys, such as video games. Accordingly, the present inventor devised, among other things, one or more exemplary water rocket systems or assemblies that include a removably mounted action figure. In some embodiments, the water rocket includes two hollow fuselage structures joined via a crossbar structure, with the action figure mounted to the crossbar structure.

8 Claims, 3 Drawing Sheets

(56) References Cited

U.S. PATENT DOCUMENTS 5,415,153 A * 5/1995 Johnson ..... A63H 27/14 124/57
5,507,451 A * 4/1996 Karnish ..... A63H 27/005 102/348
5,738,079 A * 4/1998 Keller ..... F41B 11/642 124/66
6,446,905 B1 * 9/2002 Campbell ..... B64G 1/14 244/135 R
6,460,531 B1 * 10/2002 Gourley ..... F41B 11/89 124/64
7,297,043 B2 * 11/2007 Lam ..... F41B 11/89 124/65
7,874,892 B2 * 1/2011 Hippely ..... A63H 17/006 446/198
7,900,621 B2 * 3/2011 Al-Garni ..... F41B 11/681 124/56
8,795,027 B2 * 8/2014 Kelderhouse ..... A63H 29/16 446/228
8,944,877 B2 * 2/2015 Higuchi ..... A63H 3/36 446/268
2006/0292958 A1 * 12/2006 Sun ..... A63H 27/14 446/63
2010/0282228 A1 * 11/2010 Al-Garni ..... F41B 11/681 124/59
2012/0302125 A1 * 11/2012 Choh ..... A63H 33/18 446/46
2014/0196707 A1 * 7/2014 Binkley ..... A63H 27/14 124/59
2014/0331984 A1 * 11/2014 Brahler, II ..... F41H 13/0006 124/76

* cited by examiner

100

WATER ROCKET TOYS, ASSEMBLIES, COMPONENTS, AND METHODS

RELATED APPLICATION

The present application claims priority to U.S. Provisional Patent Application 62/001,249, which was filed May 21, 2014 and which is incorporated herein by reference.

COPYRIGHT NOTICE AND PERMISSION

A portion of this patent document contains material subject to copyright protection. The copyright owner has no objection to the facsimile reproduction by anyone of the patent document or the patent disclosure, as it appears in the patent and trademark office patent files or records, but otherwise reserves all copyrights whatsoever. The following notice applies to this document: Copyright © 2014, ADAM L. FLANAGAN.

TECHNICAL FIELD

Various embodiments of the invention relate generally to water rocket toys and related methods.

BACKGROUND

Children and adults around the world have been enjoying toy rockets for decades. Among the most popular and simple to use are those that use pressurized water as a propellant. These water rockets typically include a hollow rocket body, or fuselage, which is partially filled with water, then connected to a manual hand pump that forces air into the fuselage, pressuring the water. The pressurized water can then be released from an escape nozzle at the base of the fuselage to launch the rocket skyward. The height the rocket reaches depends on numerous aspects of its design as well as the water pressurization, with heights in the 50 to 100 feet range being relatively common. The world record for a single-stage water rocket, set in 2007, is 2044 feet.

The present inventor recognized that conventional water rockets provide great initial excitement that wanes rapidly over time, with many children potentially losing interest after only several uses. The problem is compounded in view of the competition from other types of toys, such as video games, that tend to offer a more varied and ever-changing experience.

Accordingly, the present inventor has recognized a need for alternative forms of water rockets that offer greater interest and fascination.

SUMMARY

To address one or more of these and/or other needs or problems, the present inventor devised, among other things, one or more exemplary water rocket systems, kits, methods, devices, assemblies, and/or components.

In one exemplary embodiment, the invention takes the form of a water rocket assembly having a removably mounted action figure with the action figure configured to be launched simultaneously with the water rocket. In some embodiments, the water rocket includes two hollow fuselage structures joined via a crossbar structure. In some embodiment, the crossbar structure is hollow and in fluid communication with the two fuselage structures, allowing simultaneously filling of the fuselage structures with water. In some embodiments, the fuselage structures rest on a launch platform having a pair of launch tubes, with each of the tubes extending upward from the platform through an exhaust nozzle of a corresponding one of the fuselage. The launch tubes are fluidly coupled to a common pressure source, such as a hand pump, enabling simultaneous pressurization of the two fuselage structures. In still other embodiments, the two fuselages are mechanically connected via a cross retaining bar and the cross retaining bar engages with a latch that is remotely triggerable via a mechanical actuator.

BRIEF DESCRIPTION OF THE DRAWINGS

Various embodiments are described herein with reference to the following attached figures (Figs). These figures are annotated with reference numbers for various features and components, and these numbers are used in the following description as a teaching aid, with like numbers referring to the same or similar features and components.

DETAILED DESCRIPTION OF THE EXEMPLARY EMBODIMENT(S)

This document, which incorporates drawings and claims, describes one or more specific embodiments of one or more inventions. These embodiments, offered not to limit but only to exemplify and teach the invention, are shown and described in sufficient detail to enable those skilled in the art to implement or practice the invention(s). Thus, where appropriate to avoid obscuring the invention(s), the description may omit certain information known to those of skill in the art.

Figure 1:
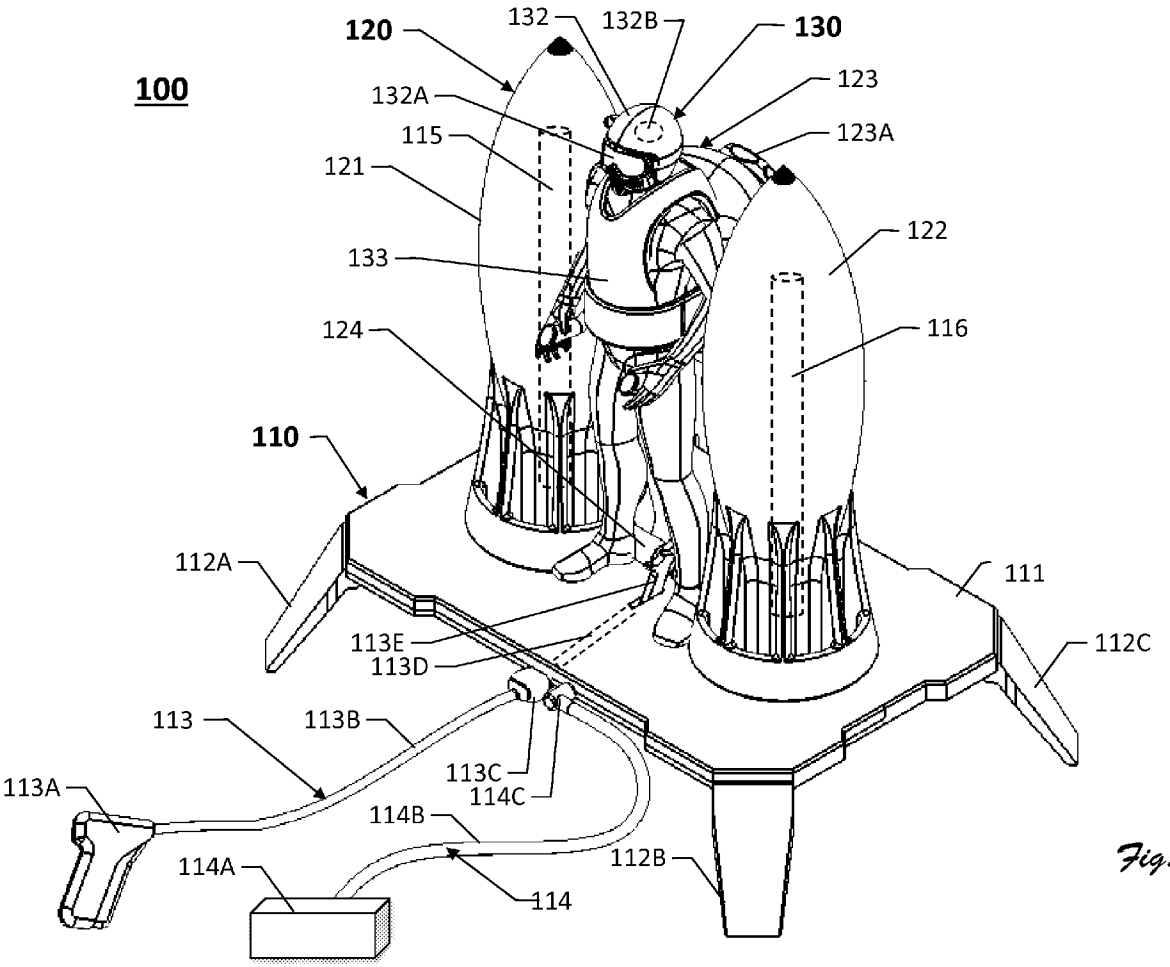
FIG. 1 is a front perspective view of a water rocket action figure assembly corresponding to one or more embodiments of the present invention.

FIG. 1 shows a water rocket action figure system or assembly 100. Assembly 100 includes a launch platform assembly 110, a water rocket assembly 120, and an action figure 130.

Figure 2:
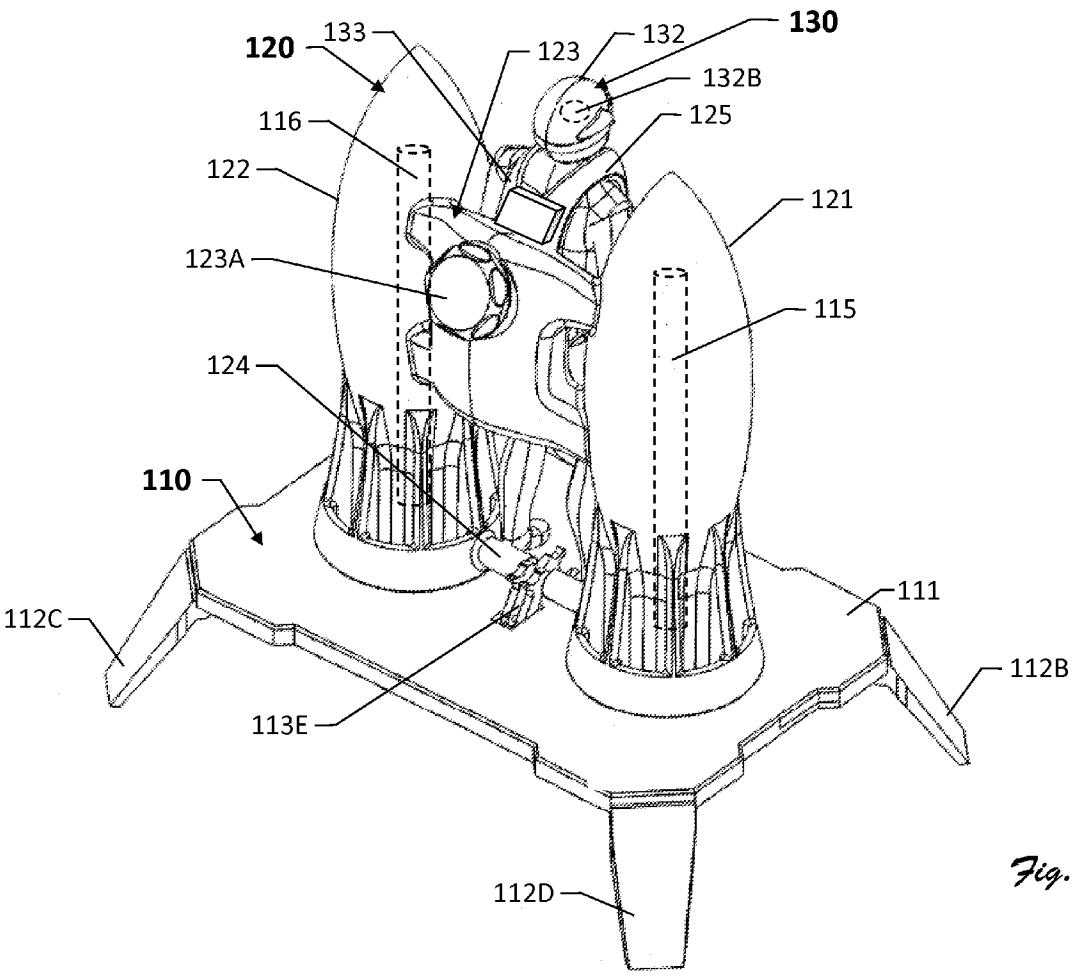
FIG. 2 is a back perspective view of the FIG. 1 assembly, corresponding to one or more embodiments of the present invention.
Figure 3:
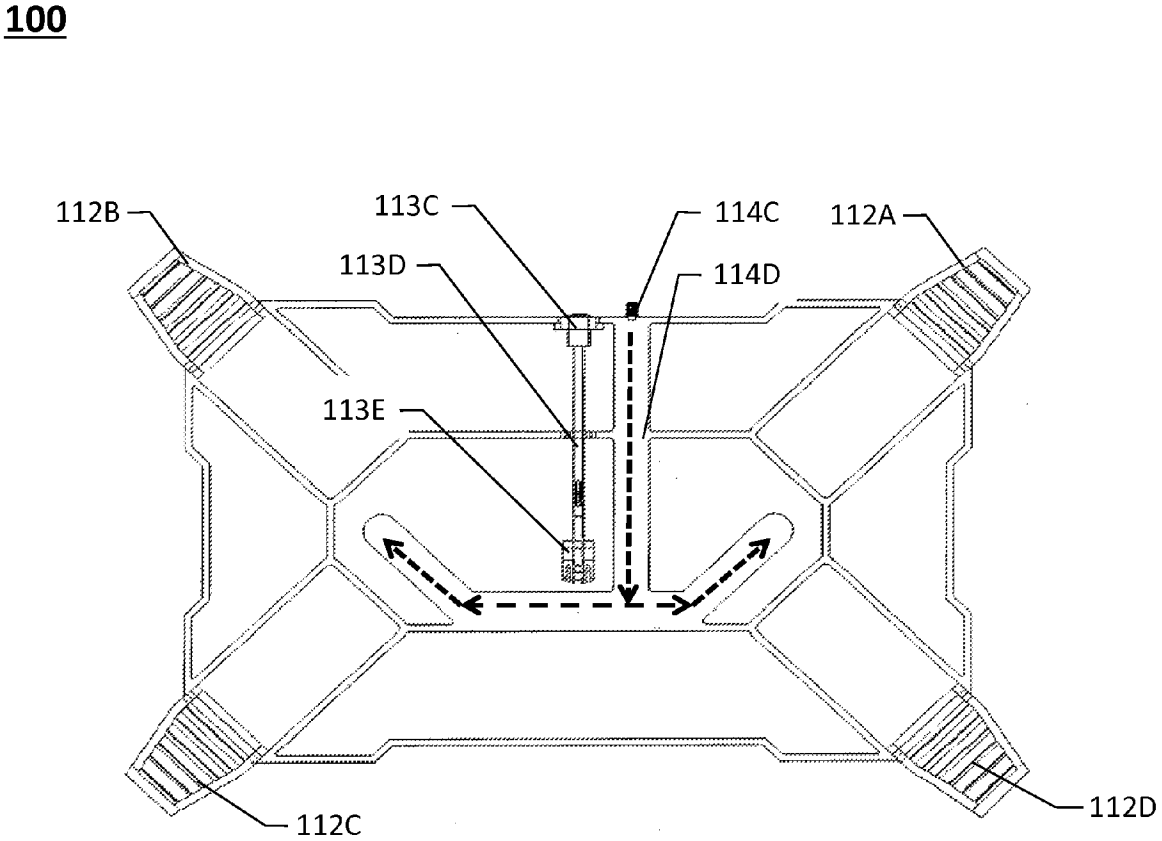
FIG. 3 is a bottom view of the FIG. 1 assembly, corresponding to one or more embodiments of the present invention.

Launch platform assembly 110, which is generally formed of injection molded plastic and machined metal, includes a base 111, legs 112A-112D, trigger assembly 113, pressurization assembly 114, and launch tubes 115 and 116. Base 111 provides a flat support surface, which is elevated via four legs 112A-112D, with leg 112D visible only in FIGS. 2 and 3. Trigger assembly 113 includes a pistol style hand-squeezable trigger mechanism 113A, a Bowden type cable linkage 113B, a coupling member 113C, a linkage 113D, and a rocket retaining latch 113E. Pistol style trigger mechanism 133A is coupled via Bowden cable linkage 113B to coupling member 113C and then through a linkage 113D, shown best in FIG. 3, to rocket retaining latch 113E. Actuation of the trigger mechanism 113D pulls the internal cable of the Bowden cable linkage, lifting the retaining latch, which is spring biased in a closed or latched position in the exemplary embodiment over a retaining crossbar 124.

Pressurization assembly 114 includes a pressure source 114A, a pressure hose 114B, and a coupling member 114C. Pressure source 114A, which can take the form of a manual hand or foot pump, a motorized pump, or pressurized air or other gas canister, is in fluid communication via coupling member 114C with duct or conduit structure 114D on the underside of base 111 (shown best in FIG. 3.) Coupling member 114C takes the exemplary form of a Schrader or Presta type of valve connection. However, some embodiments use other forms of hose and one-way valve connections. Duct structure 114D branches to fluidly couple pressure source 114A with launch tubes 115 and 116, which feed upward from base 111 into respective rocket tanks 121 and 122 of water rocket assembly 120.

In addition to rocket tanks (or fuselages) 121 and 122, and retaining bar 124, water rocket assembly 120 includes a crossbar tank 123. Rocket tanks 121 and 122, which have central axes aligned respectively with launch tubes 115 and 116, are mechanically joined by and fluidly coupled via crossbar tank 123. Crossbar tank 123 includes a screw-off cap 123A, which is removable to allow simultaneous and even filling of rocket tanks 121 and 122 with water or other desired fluid. Some embodiments provide separate fill ports for each of the rocket tanks, for example via allowing the conical tips of the rocket tanks to be threaded off. Some embodiments also allow the rocket tanks to operated independently via providing separate triggers, retaining latches, and retaining bars or catches and allowing separation of the rocket tanks from the crossbar tank and common retaining bar. In some of these embodiments, the crossbar tank snap fits onto rocket tanks. Attached to crossbar tank 123 is action figure 130.

Action figure 130 includes a human-like body 131, a helmet 132, and a harness structure 133. Human-like body 131 includes two articulable arms, two articulable legs, and a head. The head is covered via a helmet 132, which includes a goggle region 132A and an embedded battery-powered digital video camera module 132B. Goggle region 132A includes an opening for the camera sensor, and the digital vide camera module includes an accelerometer and/or altitude sensor as well as wireless transmission circuitry, for example Bluetooth circuitry to enable wireless communication of video images to a paired smartphone or other Bluetooth compliant receiver. In some embodiments, one or more portions of the camera module are distributed into the torso region of body 131. The torso region is fitted into harness structure 133, which snap fits or otherwise removably attaches to a front portion of crossbar tank 123. In some embodiments, harness structure 133 includes a rear-mounted parachute 133A, which deploys in response to active or passive accelerometer or inertial sensors. In some embodiments parachute 133A is mounted on the front of harness 133A. In some embodiments, harness 133A, for example, the parachute includes a radio-controlled (e.g., Bluetooth controllable) quadcopter drone, which allows a user to fly the rocket action figure assembly and/or the action figure under control of a smartphone or other compatible controller.

In exemplary operation, a user fills rocket tanks 121 and 122 simultaneously with water via crossbar tank 123. When filled the user tightens cap 123A and attaches pressure hose 114B to coupling member and then pressurizes the tanks to a desired pressure. Some embodiments include pressure relief valves to prevent over pressurization of the tanks. Once pressurized, the user can stand away from the platform 111 and actuate trigger mechanism 113D. Actuating the trigger mechanism pulls the internal cable of Bowden cable linkage 113B, lifting the retaining latch 113E away from retaining crossbar 124 and allowing rocket action figure assembly 120 to separate from platform 110 under the joint propulsive force of the pressurized water from tanks 121 and 123. Once the rocket action figure assembly reaches a desired height or the apex of its flight, inertial sensors trigger operation of camera module 132B and/or parachute 133A. In some embodiment, camera module 132B is triggered via initial movement of rocket action figure assembly.

In some embodiments, action figure 130 is replaced with an alternative cargo or payload structure that snap fits onto the crossbar structure. In some embodiments, the payload structure includes wirelessly controllable payload doors to allow dropping a payload remotely.

CONCLUSION

In the foregoing specification, specific exemplary embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms, such as second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed. Also, the term "exemplary" is used as an adjective herein to modify one or more nouns, such as embodiment, system, method, device, and is meant to indicate specifically that the noun is provided as a non-limiting example.

What is claimed is:

1. A water rocket action figure assembly comprising:

first and second water rocket fuselage tanks configured to hold water under pressure, with the first water rocket fuselage tank connected via lower and upper crossbar structures to the second water rocket fuselage tank and the first and second water rocket fuselage tanks having respective first and second exhaust nozzles; an action figure removably attached to at least the upper crossbar structure; and a launch platform having first and second launch tubes extending vertically from a surface of the platform and configured to extend through the respective first and second exhaust nozzles into the first and second water rocket fuselage tanks, with each of the launch tubes in fluid communication with a pressure source to enable simultaneous pressurization of the first and second water rocket fuselage tanks, wherein the launch platform includes a releasable latch assembly that engages the lower crossbar structure and inhibits separation of the first and second water rocket fuselage tanks and the upper and lower crossbar structures from the launch platform when the first and second rocket fuselage tanks are pressurized and is releasable to allow launch of the first and second water rocket fuselage tanks, the upper and lower crossbar structures, and the removably attached action figure.

2. The water rocket action figure assembly of claim 1, wherein the upper crossbar structure is hollow, in fluid communication with the first and second tanks, and includes an opening allowing simultaneous filling of the first and second tanks with water.

3. The water rocket action figure assembly of claim 1, wherein each of the launch tubes is in fluid communication with a conduit structure attached to the platform; and wherein the conduit structure is in fluid communication with a coupling member configured to couple to pressure source to enable simultaneous pressurization of the first and second tanks.

4. The water rocket action figure assembly of claim 3, wherein the latch assembly is spring biased to engage the lower crossbar structure.

5. The water rocket action figure assembly of claim 1, further comprising a pull cable, with one end of the pull cable linked to open the latch assembly and the other end of the pull cable linked to a trigger mechanism for pulling the pull cable.

6. The water rocket action figure assembly of claim 1, wherein the action figure includes a torso attached to four articulable limbs and a head, with the torso having a harness structure mounted thereto, wherein the harness structure is attached to a parachute.

7. The water rocket action figure assembly of claim 6, wherein the action figure includes a wireless camera circuit configured to transmit digital image signals wirelessly to a smartphone.

8. The water rocket action figure assembly of claim 7, wherein the wireless camera circuit is configured to automatically initiate transmission of digital image signals in response to inertial data.

* * * * *